US005743729A

United States Patent [19]

Pavlicevic et al.

[11] Patent Number: 5,743,729

[45] Date of Patent: Apr. 28, 1998

[54] COOLING DEVICE WITH PANELS FOR ELECTRIC ARC FURNACES

[75] Inventors: Milorad Pavlicevic, Udine; Gianni Gensini, Buia; Alfredo Poloni, Fogliano Di Redipuglia; Romano Sellan, Trieste, all of Italy

[73] Assignee: Danieli & C. Officine Meccaniche SpA, Buttrio, Italy

[21] Appl. No.: 798,729

[22] Filed: Feb. 13, 1997

[30] Foreign Application Priority Data

Feb. 14, 1996 [IT] Italy ..... UD96A0019

[51] Int. Cl.[6] ..... F27D 1/12

[52] U.S. Cl. ..... 432/238; 62/331; 373/76

[58] Field of Search ..... 62/331; 432/238; 373/74, 76

[56] References Cited

U.S. PATENT DOCUMENTS

| | | | |
|---|---|---|---|
| 4,423,513 | 12/1983 | DeLong | 373/76 |
| 4,453,253 | 6/1984 | Lauria et al. | 432/238 |
| 4,458,351 | 7/1984 | Richards | 373/76 |
| 5,241,559 | 8/1993 | Hixenbaugh | 373/76 |

FOREIGN PATENT DOCUMENTS

| | | |
|---|---|---|
| 0025604 | 3/1981 | European Pat. Off. . |
| 699885 | 3/1996 | European Pat. Off. . |
| 2631982 | 1/1978 | Germany . |
| 2928964 | 1/1981 | Germany . |
| 3023285 | 1/1982 | Germany . |
| 4223109 | 9/1993 | Germany . |
| 2006410 | 5/1979 | United Kingdom . |
| 2270146 | 3/1994 | United Kingdom . |

*Primary Examiner*—Ronald C. Capossela

*Attorney, Agent, or Firm*—Antonelli, Terry, Stout, & Kraus, LLP

[57] ABSTRACT

Cooling device with panels for arc electric furnaces, which is used in an electric melting furnace in cooperation with the vertical sidewall placed above the lower shell (11) of the furnace, the furnace comprising in its lower part one lower shell (11) to contain a bath (12) of melting metal and an upper shell defined by a plurality of panels (16) comprising a plurality of cooling tubes (17), the lower shell (11) including at its outer part a metallic containing element (15), the inner refractory having an upper edge (19) located substantially at the level of the upper edge of the layer of slag (14) contained above the bath (12) of melting metal, at least part of the outer panel (16) consisting of a horizontal row (18) of cooling tubes (17) arranged slightly above a substantial part of the upper refractory edge (19) of the lower shell (11).

21 Claims, 2 Drawing Sheets

COOLING DEVICE WITH PANELS FOR ELECTRIC ARC FURNACES

BACKGROUND OF THE INVENTION

This invention concerns a cooling device with panels for electric arc furnaces.

The device according to the invention is applied to electric arc melting furnaces in cooperation with the sidewalls and upper walls of the furnace and, to be more exact, to the lateral zone immediately above the refractory lower shell which holds the bath of melting metal.

The structure of electric melting furnaces and, in particular, of electric arc furnaces is known.

These furnaces include in their lower part a refractory lower shell, which incorporates the hearth of the furnace and above which is included an upper shell that acts as a sidewall on which are positioned the cooling panels.

In the state of the art the sidewall of the furnace is defined by a row of those lateral panels arranged substantially at the upper edge of the lower shell; this situation makes possible the at least partial formation of a layer of slag, which fixes itself to those panels but is not enough to protect the refractory material from the very violent thermal and chemical stresses met with in the present arc furnaces.

This layer of slag has an insulating task of reducing the flow of heat and therefore of preserving the cooling panels at least partly from premature wear.

This arrangement, however, is not particularly effective since the slag fixes itself with difficulty to the inner surface of the panels and therefore cannot form a compact and uniform layer suitable to perform effectively the task of thermal insulation.

Moreover, it is known that one of the greatest shortcomings which take place in a melting furnace with the progress of the melting cycles concerns the wear and progressive erosion of the refractory material constituting the lower shell in the zone at the level of the upper edge of the slag, that is to say, substantially at the upper circular strip of the lower shell.

In this upper zone of the lower shell the combination of the temperature and of the effects of the violent chemical reactions taking place during the melting process leads to accentuated occurrences of erosion which damage structurally the refractory material progressively.

This forces the operatives to take action between one cycle and another so as to restore the correct conditions of efficiency of the refractory and therefore to obviate the risk of break-outs very dangerous for the safety of the personnel.

Moreover, with this type of panel the heat flow directed towards the outside of the furnace is very great and a great quantity of energy is lost.

This is due to the great extent of the surface on which the heat exchange takes place inasmuch as the tubes forming these panels are adjacent to each other and cover the whole lateral surface of the furnace in the zone where there is no refractory material.

GB-A-2.270.146 shows an electric furnace with lateral cooling panels located above the shell and with cooling tubes which act on the zone of the lower refractory shell.

DE-C-4223109 shows panels with a plurality of horizontal mono-tubes arranged in two parallel rows and separated at regular intervals.

EP-A-0699885, published after this invention was filed, shows a cooling system for the upper edge of the refractory part of the furnace.

This system includes a plurality of cooled tubes arranged in a 'U' with the vertical tubes facing towards the bath of liquid metal.

This arrangement entails a plurality of problems, on the one hand because the continuous tubes, in the event of a breakage, become unusable, and on the other hand because, as they face the bath of liquid metal, they are easily subject to perforations.

On the contrary, if these tubes were to be protected, they would no longer achieve the desired effect.

SUMMARY OF THE INVENTION

The present applicants have designed, tested and embodied this invention to overcome these problems, which have been the subject of complaints by businessmen in this field for some time now, and also to achieve further advantages.

This invention is set forth and characterised in the main claim, while the dependent claims describe variants of the idea of the main embodiment.

The purpose of the invention is to provide a cooling device with panels in electric furnaces, the device enabling the problem of progressive wear of the refractory at the upper circular strip of the lower shell to be avoided or at least greatly reduced.

A further purpose of the invention is to embody a cooling device with panels which enables the insulation properties of the layer of slag to be exploited in the most efficient manner, thus preserving the panels against progressive consumption and wear and therefore increasing the working life of those panels considerably.

Yet another purpose of the invention is to obtain a cooling device with panels in which the critical points are reduced to a minimum along the hydraulic circuit defined by the cooling panels and therefore the possibility of breakdowns and cracking of the cooling device is reduced.

According to the invention the cooling device with panels comprises at least one row of cooling tubes arranged substantially horizontally, or even partly inclined downwards and outwards, in cooperation with the upper edge of the refractory lower shell which holds the melting bath This substantially horizontal row of tubes is easily covered by the slag which protects it and has the purpose of cooling the upper zone made of refractory material of the lower shell substantially at the upper level of the slag present on the bath of liquid metal, this zone being thus more subject to wear and erosion caused by the slag during the progress of the melting cycle.

The cooling action of this substantially horizontal row of tubes drastically reduces the wear on the refractory of the lower shell by the slag on the bath of liquid metal.

According to the invention, the row of tubes which cooperates with the upper edge of the refractory of the lower shell consists of panels, that is to say, of autonomous elements each of which covers a certain round angle of the circular crown defined by the edge.

According to a variant, the upper zone of the lower shell is conformed as a refractory ring having a diameter greater than the lower part of the furnace.

The height of the ring may be substantially the same as the height of the layer of slag on the bath of liquid metal; according to another variant, the height of the ring is greater than the height of the layer of slag.

The inclusion of this ring enables the surface of heat exchange to be increased between the upper refractory zone of the lower shell and the cooling device with panels according to the invention.

According to this embodiment, the refractory ring is cooled by at least one row of tubes, substantially horizontal or even partly inclined downwards and outwards, which covers the whole upper surface of the ring and then extends outside the upper sidewall of the furnace.

According to a variant the ring is cooled also along its vertical side so as to increase the quantity of flow of heat removed by the cooling device.

According to a further variant the ring is cooled at least partly at its lower edge too, and as far as the outer edge of the lower shell.

According to these last two embodiments, a plurality of holes are provided in the sheet metal outer containing element for the discharge of water in the event of breakage of one or more of the cooling tubes.

According to a further variant the sheet metal outer surface which protects and mechanically contains the refractory ring placed in cooperation with the layer of slag above the bath of liquid metal is cooled by a plurality of jets of water.

According to this variant, the water which laps the outer surface evaporates in the environment and removes heat from the refractory ring without causing shortcomings.

According to this variant, it is also possible to use a closed system in which the water sprayed by these jets is collected and re-used.

The substantially horizontal row of cooling tubes, according to the invention, is located, in relation to the melting bath, above the zone considered to be the safety zone, and is protected by its horizontal position which enables it to be rapidly covered by the slag; this contributes towards increasing the quotient of reliability of the panel as regards any breakages and losses of water in a zone which is especially near to the molten bath.

According to the invention, in cooperation with the horizontal row of tubes which cools the upper edge of the lower shell and above that row, the cooling device comprises a double layer of cooling tubes organised as panels.

This double layer of cooling tubes, namely an inner layer and an outer layer respectively in relation to the inside of the furnace, develops substantially vertically so as to cover a substantial part of the inner sidewall of the furnace above the lower shell.

According to the invention, the outer layer of each individual panel, that is to say, the layer which cooperates with the outer part of the furnace, is composed of tubes arranged substantially in contact with each other, thus forming substantially a continuous wall.

Also according to the invention, the inner layer of cooling tubes is rarefied and is placed at a certain distance from the outer layer and can be parallel or inclined with respect thereto.

The rarefaction of the tubes of the inner layer therefore leaves wide open spaces between one tube and the other.

The outer cooling tubes are continuous for each panel or, according to a variant, subdivided into several autonomous circuits.

The inner cooling tubes are continuous and normally constitute a single circuit.

The inclusion of this double layer of cooling panels allows the slag to enter and be retained; it also makes possible a better fixture of the slag to the panels, with the result of a formation of a thicker, more compact and more uniform layer in the interspace between the two layers of panel, so as to function as protection and a heat accumulator.

In fact, the slag in the space between the two layers of panels is kept at a temperature lower than the melting temperature owing to the heat exchange with the tubes.

This slag is therefore not readily removed, even during the steps of charging the furnace when the mechanical stresses cause the release and the falling of the slag from the panels in the present furnaces.

Moreover, this slag remains hot during the tapping step, and the stored energy is yielded thereafter to the new charge, thus making possible a great saving of energy.

According to the invention, at least the inner layer of tubes includes means to support and anchor the slag.

This slag, which anchors itself onto the inner layer, has a temperature of about 1350° C. corresponding to the melting temperature; moreover, this molten slag, which possesses a thermal conductivity greater than that of the solid slag present between the inner and outer layer of the panel, prevents local overheating due to discharges of the arc.

Moreover this molten slag distributes the thermal and mechanical stresses due to those discharges over a huge area and transfers them downwards during its teeming onto the panels.

The cooled refractory edge too of the lower shell is further protected by the slag which continues to teem onto that edge inasmuch as the flow of slag does not become exhausted but continues to be fed by the reserve of slag accumulated between the inner and outer layers of the individual panel.

This solution leads to considerable advantages as regards protection against the wear and consumption of the panels themselves; moreover, it gives advantages in terms of duration and energy saving.

In the embodiment according to the invention the layer of slag between the two layers of a panel may reach a thickness up to 200 mm.

So as to prevent excessive teeming of the liquid slag from the tubes of the two layers of each individual panel and to assist the anchorage of new slag, those tubes may be equipped with elements to anchor the slag which are of a traditional type, such as metallic hooks for instance.

However, the traditional hooks positioned on the tubes of the inner panels are often damaged and melt and cannot withstand the great flow of heat which they undergo owing to the insufficient coefficient of heat exchange of the metal of which they consist.

So as to obviate this problem, a variant of the invention provides for the employment of anchorage elements consisting of a series of cooled rings of a material possessing great thermal conductivity such as copper, for instance, these rings not only enabling the slag to be anchored but making possible a great flow of heat towards the cooled tube.

The form of the ring according to the invention can be toroidal or notched so as to increase the anchorage of the slag.

The cooled rings can be welded to the tube or be fitted thereto without welding when the coefficients of thermal expansion of the tube and of the ring are such as to enable their surfaces to be in contact with each other.

According to a further variant, the elements to anchor the slag consist of hooks having any shape and comprising elements of a material having a great thermal conductivity.

The inner layer of tubes of the individual panel is secured to the outer layer by fixture hooks to obtain connection and reciprocal positioning.

These hooks, even if they are protected by the slag forming in the interspace between the two layers of panels, undergo great mechanical and thermal stresses and have a determined attainable limit of maximum length, which therefore limits also the maximum thickness of the insulating layer of slag.

According to a variant of the invention these connecting hooks are embodied with a bimetallic structure suitable to increase their heat resistance and mechanical strength.

Where the working conditions require a thickness of slag such as will make necessary a greater distance between the inner and outer layers of the individual panel, a variant of the invention arranges for insertion of a third intermediate layer, which likewise does not cover the whole surface of the panel, so as to reduce the length of the hooks and, at the same time, to cool them in the correct manner.

According to a further variant the connecting hooks are cooled internally by circulation of a cooling fluid.

According to the invention the tubes employed are of a type without welding, thus reducing considerably the critical points most subject to the thermal stresses and increasing greatly the working life of the panels.

The tubes which form the panels can have, according to a further variant, sections of a non-circular shape so as to optimise the coefficient of heat exchange by adjusting the speed of the cooling water and reducing the overall rate of flow of water by making the water circulate only in the part of the tube exposed to the flow of heat.

According to this variant, embodiments can be used which provide for insertion of one tube within another tube, or include half-moon sections or other types of sections.

The part of the tube in which the cooling water does not circulate may be filled with suitable material or fluid or be left empty.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
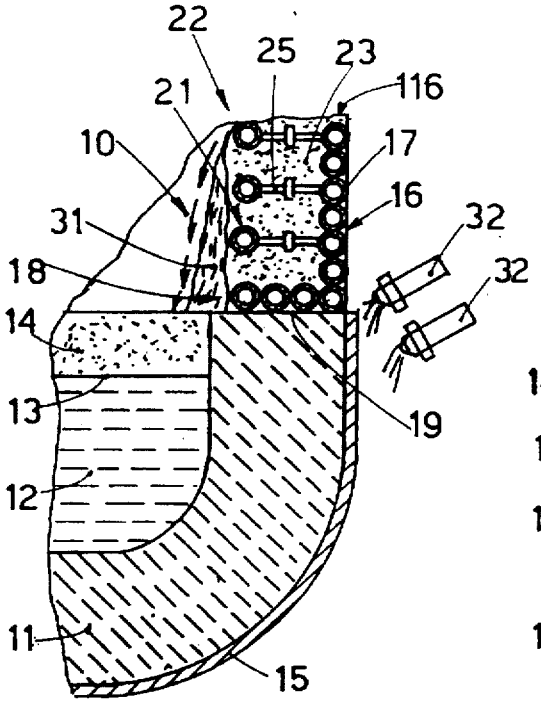
FIG. 1 shows a part of the lower portion of an electric furnace equipped with a cooling device with panels according to the invention.

An electric furnace, of which the lower portion is shown partly in FIGS.1 to 4 comprises a lower shell 11 consisting of a refractory material and acting as a container for a bath 12 of melting metal.

This bath 12 of melting metal has an upper level 13 above which is included a layer of slag 14.

The lower shell 11 cooperates on its outside with a metallic supporting and containing element 15.

The furnace comprises above the lower shell 11 a circular upper shell defined by a plurality of cooling panels 16 comprising a plurality of adjacent tubes 17 inside which a cooling liquid circulates.

This plurality of cooling panels 16, which stand substantially vertical above the lower shell 11, constitutes the cooling device 10.

The cooling device 10 according to the invention also includes a panel, or a portion of panel 16, composed of a plurality of adjacent cooling tubes cooperating directly with the upper refractory edge 19 of the lower shell 11.

These cooling tubes, or horizontal row 18 have the task of cooling intensively the upper zone of the lower shell 11, which zone is located substantially at the level of the layer of slag 14, which is above the bath of molten metal 12.

This refractory zone of the lower shell 11, as is well known, is most subject to progressive wear and erosion during the progress of the melting cycle.

In the embodiment of FIG. 1 the panel consisting of the cooling tubes 18 cooperates with a plurality of tubes 17 placed substantially in contact with each other; the plurality of tubes 17 constitutes the outer layer 116 of the panel 16 and extends vertically above the upper edge 19 of the lower shell 11 and to the substantially outer periphery of the lower shell 11.

The panel 16, in this case, comprises above the horizontal row 18 a double layer of cooling tubes, respectively the outer layer 116 and the inner layer 22.

The two layers of cooled tubes 116 and 22, which constitute the vertical walls of the panel 16, define between them an interspace 23 inside which the slag accumulates to form an insulating layer which protects the layers 116,22, and the horizontal row 18, from consumption and from wear.

The structure with two layers 116 and 22 of the panels 16 makes it possible for the slag to be retained and anchored inside the interspace 23, and thus to form a layer of slag of the desired thickness which is compact, uniform and constitutes a heat accumulator.

The distance between the two layers 116, 22 is advantageously between about 50 mm and about 150 mm; with such a structure, the thickness of the layer of slag can reach as much as 200 mm.

FIG. 1 shows as an example liquid slag 31 running down from the panels 16.

In this case the outer side of the lower shell 11 is cooled with jets of water by means of appropriate nozzles 32.

Figure 2:
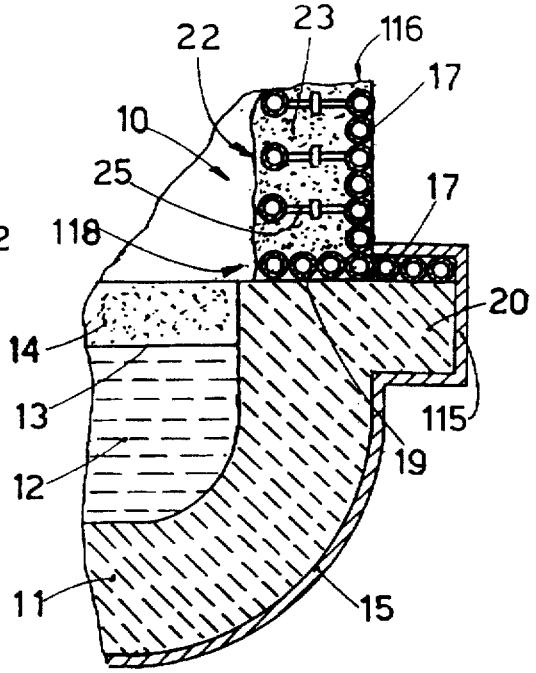
FIG. 2 shows a first variant of FIG. 1.
Figure 3:
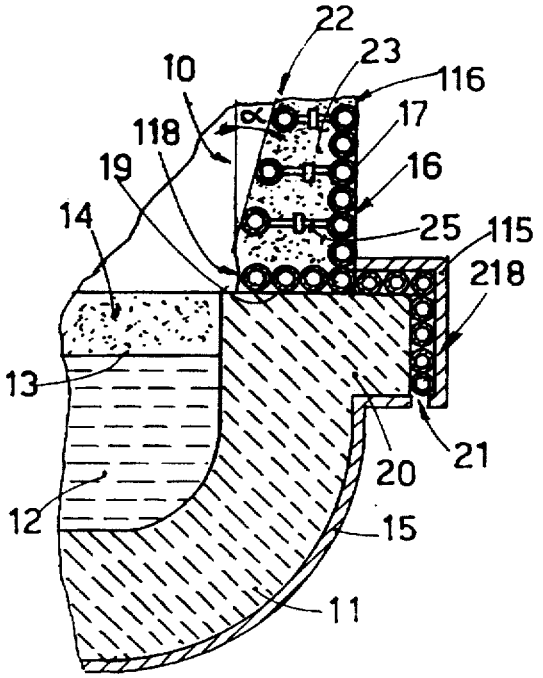
FIG. 3 shows a second variant of FIG. 1.
Figure 4:
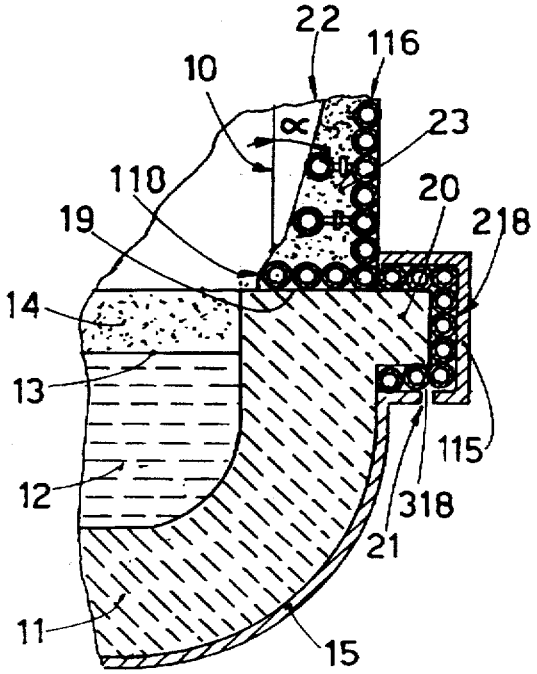
FIG. 4 shows a third variant of FIG. 1.

According to the variant of FIGS. 2, 3 and 4, the upper refractory portion of the lower shell 11 is shaped like a ring 20 which has an outer diameter greater than the outer diameter of the containing element 15.

This upper portion shaped like a ring 20 has a height at least equal to the height of the layer of slag 14.

The upper refractory portion shaped like a ring 20 has its own containing, protecting and supporting element 115, which is made of metal.

This upper refractory portion shaped like a ring 20 cooperates at least for the length of its upper horizontal extent (FIG. 2) with the first horizontal row 118 of cooling tubes, thus increasing the surface of heat exchange at the critical zone and a greater removal of the flow of heat.

According to the variant of FIG. 3, there is also included a vertical row 218 of cooling tubes.

According to the invention, there is a plurality of discharge holes 21 included in the outer containing element 115 and having the purpose of discharging the cooling liquid in the event of breakages or breakdowns in the cooling circuit.

According to a further variant shown in FIG. 4 there is a further lower horizontal row 318 of cooling tubes.

According to the invention the inner layer 22 of the panel 16 may have a development substantially parallel to the outer layer 116 FIGS.1 and 2), or may have a development parallel in its first, lower segment, that is to say the one nearest the lower shell 11, where the insulation is more important, and then inclined towards the outer layer 116 in its upper segment (FIG. 3), or else may have a development inclined along its whole length (FIG. 4).

In these cases the inclination of the inner layer 22 towards the outer layer 116 of cooling tubes 17 defines an angle "α" between 8° and 30°, with the angle "α" being able to vary from panel 16 to panel 16.

The greater or lesser inclination of the inner layer 22 may depend also on the proximity or otherwise to the electrodes of the furnace.

The anchorage of the slag to form the insulating layer on the outer layer 116 and/or the inner layer 22 is assisted by the inclusion of anchorage elements 24 (FIG. 5) distributed substantially along the whole surface, and also by the inclusion of connecting hooks 25 between the inner layer 22 and outer layer 116.

Figures 6, 7, 12:
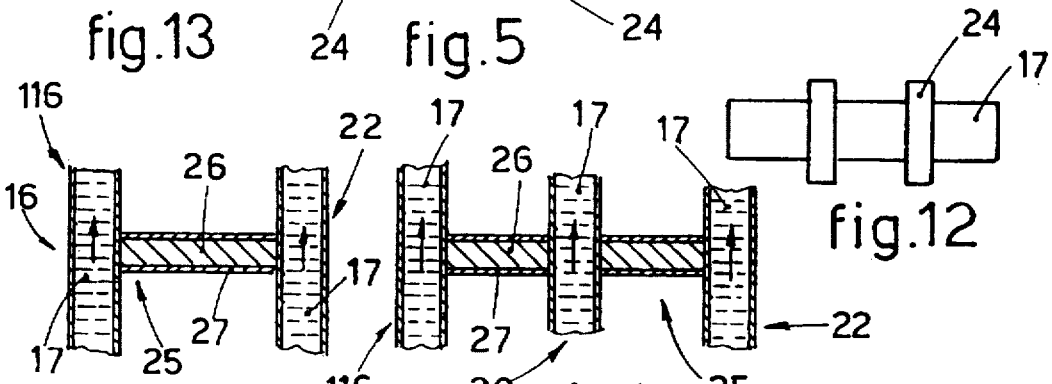
FIG. 6 shows an example of a hook for connecting the inner and outer layers.
FIG. 7 shows a variant of FIG. 6.
FIG. 12 is a side view of a cooling tube equipped with elements for anchorage of slag.
Figure 8:
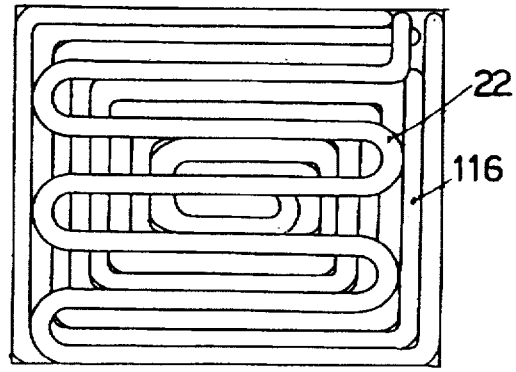
FIGS. 8 and 9 show respectively a front view and a view from above of the cooling device with a double layer of cooling tubes according to the invention.

FIG. 12 shows a cooling tube 17 equipped with anchorage elements 24 consisting of cooling rings of a material possessing a high thermal conductivity.

Figures 5, 10, 11, 13:
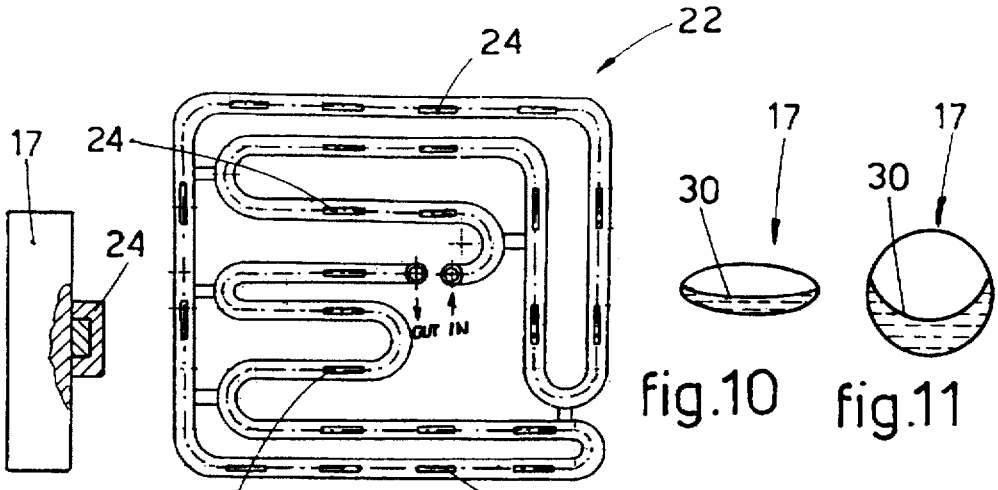
FIG. 5 shows a front view of an inner layer of cooling tubes according to the invention.
FIG. 10 shows a cross-section of a cooling tube equipped inwardly with a second tube to reduce the rate of flow.
FIG. 11 shows a variant of FIG. 10.
FIG. 13 shows a variant of FIG. 12.

FIG. 13 shows a variant of FIG. 12 with the anchorage elements 24 consisting of hooks of a material having a high thermal conductivity and possibly embodied with a bimetallic structure.

The layers constituting the panel 16 are embodied by using tubes 17 devoid of welding, thus eliminating the critical points due to the welding and especially subject to thermal stresses during the working of the furnace.

In this case the tubes 17 are formed by bending in the hot state.

The hooks 25 which connect the inner layer 22 to the outer layer 116 of the panel have to be especially resistant to the mechanical and thermal stresses.

The greatest distance between the layers 116 and 22 and therefore the thickness of the layer of slag which forms in the interspace 23 is tied to the capacity of resistance of the hooks 25, which are especially stressed in their centre zone, namely the zone most distant from the layers 116 and 22 and therefore less cooled.

In this example, the hooks 25 are embodied with a copper core 26 having a high thermal conductivity and with an outer steel lining 27, which has high properties of mechanical strength and is capable of making the hooks 25 resistant to impacts and of permitting an easier connection to the walls of the tubes 17 constituting the layers 116, 22.

Each hook 25 has a critical temperature, above which its central zone cannot be brought without running great risks of breakages and breakdowns, and this fact dictates the maximum distance at which the layers 116, 22 can be located from each other.

Where the working conditions of the furnace make necessary an increase of the distance between the layers 116, 22, it is possible to include a third intermediate layer 28 of cooling tubes and to lessen the length of the hooks 25 and to cool them at the same time (FIG. 7).

According to a variant which is not shown, the connecting hooks 25 are cooled internally by circulation of a cooling fluid.

Figure 9:
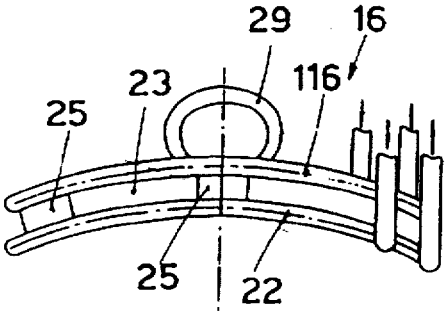

FIG. 9 shows also an engagement hook 29 which enables the panels 16 to be readily handled.

According to the embodiment of the invention shown in FIGS.10 and 11 the tubes 17 have sections other than a circular section and/or cooperate internally with partition means.

For example, the partition means consist of a second tube 30, so as to restrict the rate of flow of cooling water at the less hot points, thus achieving a saving of energy and a better efficiency of the furnace.

We claim:

1. Cooling device with panels for electric arc furnaces, which is used in an electric melting furnace in cooperation with the vertical sidewall placed above the lower shell of the furnace, the furnace comprising in its lower part one lower shell to contain the bath of melting metal and an upper shell defined by a plurality of panels comprising a plurality of cooling tubes, the lower shell having at its outer part a metallic containing element, the inner refractory having an upper edge located substantially at the level of the upper edge of the layer of slag contained above the bath of melting metal, the device being characterised in that at least part of the outer panel consists of a horizontal row of cooling tubes arranged immediately above a substantial part of the upper refractory edge of the lower shell.

2. Cooling device as in claim 1, in which the upper portion of the lower shell includes a refractory ring extending outwardly beyond the perimeter of the containing element and having an upper edge covered by an outer panel composed of a horizontal row of cooling tubes.

3. Cooling device as in claim 2, in which the refractory ring has a height at least equal to the height of the level of the layer of slag located above the melting bath.

4. Cooling device as in claim 2, in which the outer vertical wall of the refractory ring cooperates with an outer panel including a vertical row of cooling tubes.

5. Cooling device as in any claim from 2 to 4 inclusive, in which the lower wall of the refractory ring above the lower shell cooperates with an outer panel including a horizontal row of cooling tubes.

6. Cooling device as in 2, in which the refractory ring cooperates with a metallic outer containing element.

7. Cooling device as in claim 6, in which the outer containing element contains at least one hole at a lower position of the element itself.

8. Cooling device as in claim, in which the outer panel includes an outer layer and at least an inner layer of cooling tubes, the layers developing vertically and separated by an interspace.

9. Cooling device as in claim 8, which the outer layer of the outer panel includes the cooling tubes adjacent to each other and substantially covering the whole surface of the panel itself.

10. Cooling device as in claim 9, in which the the inner layer of the panel includes the cooling tubes separated from each other by wide spaces.

11. Cooling device as in claim 10, in which the inner layer is at least partly parallel to the outer layer.

12. Cooling device as in claim 10, in which the inner layer is at least partly inclined by an angle "α" between 8° and 30° to the outer layer.

13. Cooling device as in claim 8, in which at least the inner layer is embodied with a continuous tube.

14. Cooling device as in claim 8, in which the inner layer and outer layer of the panels are connected to each other by connecting hooks.

15. Cooling device as in claim 14, in which the connecting hooks have an inner copper core and an outer steel lining.

16. Cooling device as in claim 14, in which the connecting hooks include a conduit for the circulation of cooling fluid.

17. Cooling device as in claim 8, in which between the inner layer and the outer layer there is at least an intermediate layer of cooling tubes.

18. Cooling device as in claim 1, in which at least the inner layer comprises on its surface means to anchor and engage the slag.

19. Cooling device as in claim 18, in which the anchorage and engagement means are made of a material having a high thermal conductivity.

20. Cooling device as in claim 1, in which the cooling tubes contain inner partition means which define a first zone for the passage of the cooling water, this zone being exposed to the zone of removal of the thermal flow and at least a second zone not affected by the passage of the cooling water.

21. An electric arc furnace, comprising:

a lower shell to contain a bath of melting metal, the lower shell having an inner refractory material and an outer metallic containing element, the inner refractory having an upper edge located substantially at a level of an upper edge of a layer of slag contained above the bath of melting metal; and an upper shell comprising a plurality of panels, each of which covers a portion of a perimeter of the upper edge of the inner refractory, wherein at least a part of each of the plurality of panels comprises a horizontal row of cooling tubes arranged immediately above a substantial part of the upper edge of the inner refractory.

* * * * *